US005330637A

United States Patent [19]

Nemedi

[11] Patent Number: 5,330,637

[45] Date of Patent: Jul. 19, 1994

[54] INDEXABLE SCREEN FOR CENTRIFUGAL SEPARATOR DEVICE

[75] Inventor: Robert J. Nemedi, Kalamazoo, Mich.

[73] Assignee: Inter-Source Recovery Systems, Inc., Kalamazoo, Mich.

[21] Appl. No.: 88,072

[22] Filed: Jul. 6, 1993

Related U.S. Application Data

[62] Division of Ser. No. 816,592, Dec. 31, 1991.

[51] Int. Cl.[5] ..... B04B 1/04

[52] U.S. Cl. ..... 210/232; 210/372; 210/373; 494/74

[58] Field of Search ..... 210/232, 372, 373, 512.1; 494/43, 58, 59, 67, 74

[56] References Cited

U.S. PATENT DOCUMENTS

| | | | |
|---|---|---|---|
| 4,021,354 | 5/1977 | Lyon | 210/477 |
| 4,137,176 | 1/1979 | Dudley et al. | 210/375 |
| 4,186,096 | 1/1980 | Areaux et al. | 210/377 |
| 4,186,097 | 1/1980 | Dudley et al. | 210/377 |
| 4,253,960 | 3/1981 | Dudley et al. | 210/373 |
| 4,298,476 | 11/1981 | Dudley | 210/373 |
| 4,936,822 | 6/1990 | Nemedi | 494/43 |

*Primary Examiner*—Robert A. Dawson
*Assistant Examiner*—David Reitsynder
*Attorney, Agent, or Firm*—Marshall, O'Toole, Gerstein, Murray & Borun

[57] ABSTRACT

An indexable separator screen for use with a rotatable centrifugal separator device in which the screen is adapted to be moved relative to the bowl so that one or more wear areas on the screen can be moved from at least a first position to a second position relative to the bowl.

8 Claims, 2 Drawing Sheets

FIG. 2
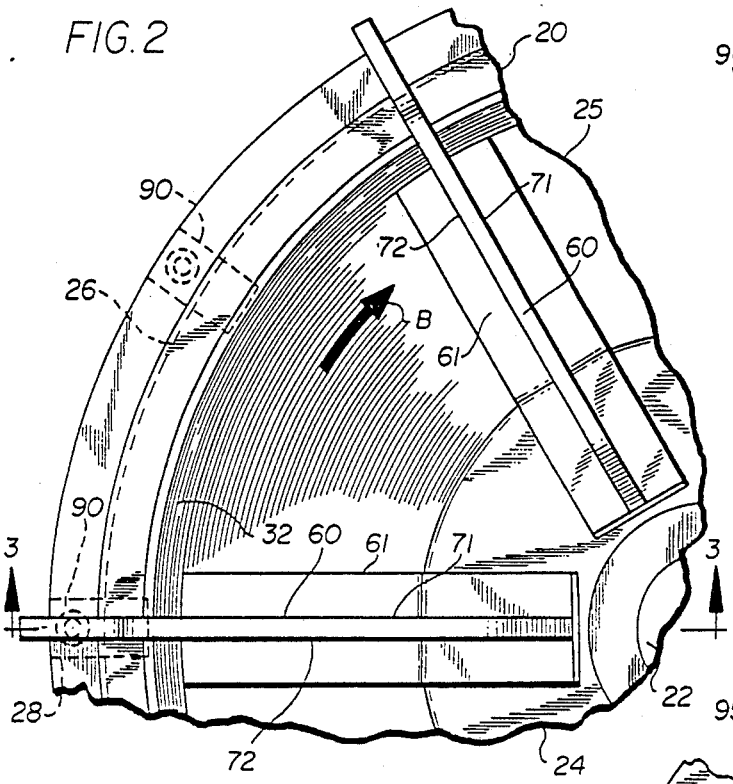
FIG. 5a
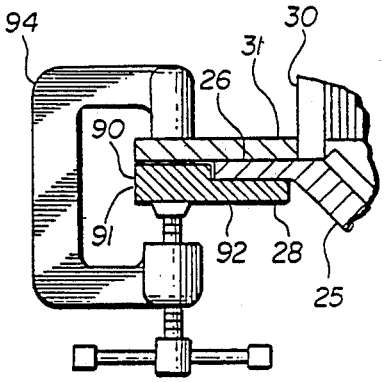
FIG. 5b
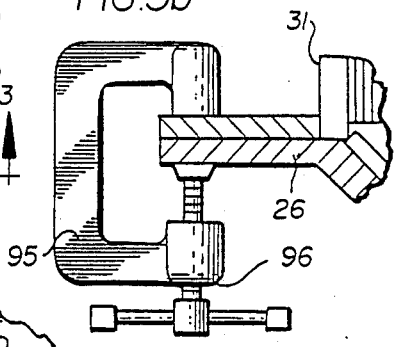
FIG. 3
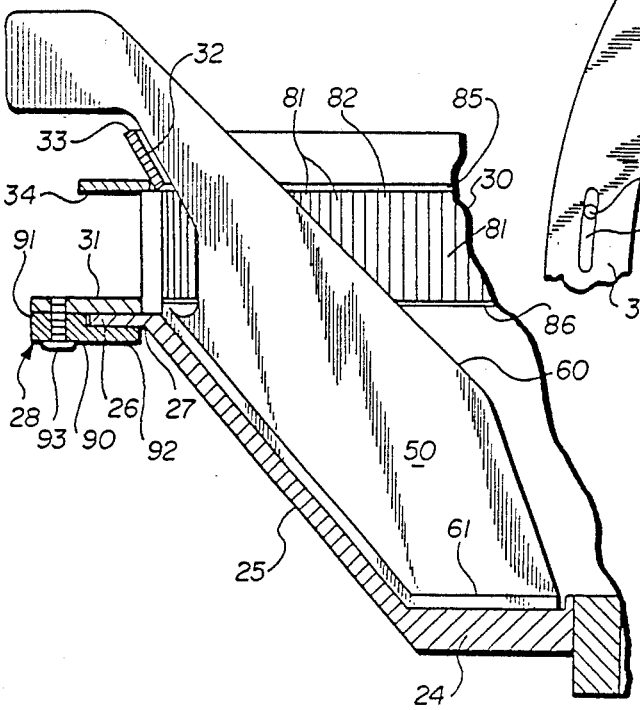
FIG. 6
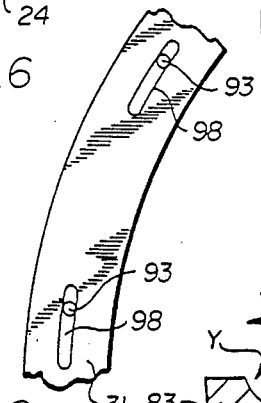
FIG. 4c
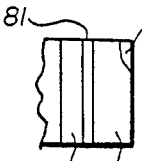
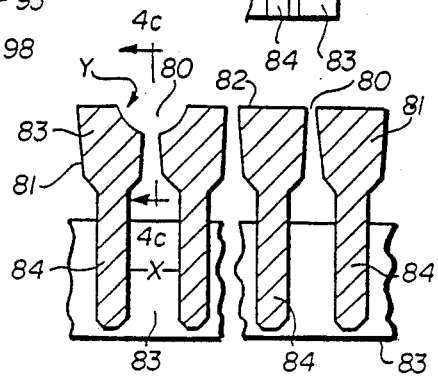
FIG. 4a FIG. 4b

INDEXABLE SCREEN FOR CENTRIFUGAL SEPARATOR DEVICE

This is a division of U.S. application Ser. No. 07/816,592, filed Dec. 31, 1991 still pending.

FIELD OF INVENTION

The invention relates generally to a centrifugal parts separator for separating lubricating and other fluids from metal or other scrap materials, and, more particularly, to an indexable separator screen employed with the separator which can be adjusted relative to a separator bowl and blade assembly so that the screen can be moved to different positions to reduce screen wear.

BACKGROUND OF THE INVENTION

Centrifuge systems for continuously removing liquid from metal chips or other material impregnated with lubricating or other fluids are known. Such a system is illustrated, for example, in U.S. Pat. No. 4,936,822 issued to William D. Nemedi. In the particular system disclosed in this patent, a centrifugal separator bowl is preferably cast with a plurality of recesses disposed in the internal vertical and bottom walls of a rotatable bowl. A plurality of blade assemblies are disposed in the various recesses, each blade assembly comprising a pad having a structural configuration of a bowl recess. A blade extends outwardly from a pad, the blade being connected to the pad along both the bottom blade edge and a substantial portion of the outer vertical blade edge. When a wear spot occurs at the intersection of a blade and pad, the blade-pad assembly is relatively readily and easily removed from a bowl recess and another blade-pad assembly can be releasably fastened in the vacated bowl recess.

While bowl wear has been reduced by the utilization of replaceable bowl/blade assemblies, a material wear problem sometimes exists with respect to the centrifugal separator. In a centrifugal separator, a porous screen which serves to pass lubricant therethrough, is fastened to the top of the separator bowl. The screen is fixed relative to the bowl and blades and rotates with the bowl and blades. One type of a porous screen is referred to as a profile screen. A profile screen includes a plurality of fingers each of which comprises an elongated relatively thin tapered bar. The fingers are spaced closely to one another in a ring-like fashion and are held together by ring plates. The fingers form a plurality of narrow tapered openings or slots having a slot thickness adjacent the front surface of the screen of approximately 0.02 inches. The screen opening is tapered outwardly so that each of the slot openings is slightly enlarged at the back surface of the screen.

When a centrifugal separator is in operation, material such as metal chips is centrifuged in the rotating bowl. As the material is centrifuged, it travels upward along the vertically inclined bowl wall and passes onto the profile screen at which location entrained lubricant or other fluid separates from the chips and passes through the narrow screen openings. The relatively dry metal chips or other solid material continue to move upward passing over the screen into a discharge chamber from which the chips exit the separator and pass to a collection site.

It has been found that, in some instances, as the chip and lubricant material travel upwardly along the inclined vertical separator bowl wall onto the profile screen, substantial areas of wear are generated both on the front or inner surface of the profile screen as well as on the separator bowl wall in areas immediately below the screen wear areas. It has been found that in various applications, excessive wear will occur at one or more locations on the screen and bowl. Areas of excessive screen wear serve to cause the relatively narrow openings or slots at the front surface of the screen to enlarge whereby metal chips or other undesired solid materials pass through the screen openings. Chips which pass through the screen openings with the fluid follow the fluid recirculation path, the adverse effect of which is that the chips can plug or otherwise damage a recirculating pump or the like in the fluid recirculation system. Further, chips which mix with the fluids which are passing through the screen openings must be collected and reprocessed through the centrifugal separator to separate the fluid from the chips, i.e., dry the metal chips or material.

It also has been found that excessive screen wear occurs predominantly at the location where the screen is positioned contiguous to one or more blades located within and attached to the rotatable separator bowl. Material to be separated travels upwardly along the inclined bowl wall and particularly at the location of the intersection of the leading edge of a blade in the direction of rotation and the bowl wall. As the material reaches the top of the bowl wall, it contacts the screen member and primarily the screen surface areas contiguous to the blades seated in the bowl. Over a period of time, excessive screen wear occurs at the areas of the screen surface positioned above and proximate to the blades. The effect is that screen wear is not uniform about the screen but rather screen wear will occur at a faster rate at different locations on the screen.

What is desired is to preclude metal chips or other undesired solid materials from passing through screen openings which have been enlarged due to screen wear. It is also desired to avoid excessive screen wear by extending the life of a screen which is a relatively costly component in a centrifugal separator device.

SUMMARY OF THE INVENTION

The invention disclosed and claimed herein serves to overcome or otherwise obviate the above-described problems and achieve the desires sought for a screen used in a centrifugal parts separator device.

Briefly, the present invention utilizes a centrifugal separator bowl/blade assembly in conjunction with a profile screen member in which the screen is releasably fastened to the bowl and is indexable or otherwise adjustable relative to the bowl/blade assembly.

When it is determined that excessive wear is occurring at one or more locations on the inner surface of the profile screen, the screen can be indexed to another location relative to the rotatable bowl thereby moving the worn screen surface(s) to another position.

By indexing the screen relative to the bowl, more uniform screen wear can be achieved, the effect of which is the screen does not wear out as rapidly as occurs with conventional screens. Thus, the present invention serves to extend the life of a screen by virtue of the reduction of screen wear at particular locations on the screen. Moreover, screen openings are precluded from becoming enlarged to an undesirable size due to screen wear such that the danger of chips passing through the screen is obviated. Further, indexing the screen can be accomplished relatively easily and over a short period of time so that machine down time due to reorienting the screen relative to a separator bowl/-blade assembly is kept to a minimum.

DESCRIPTION OF THE DRAWINGS

Further advantages of the invention will become apparent upon a reading of the following detailed description taken in conjunction with the accompanying drawings in which:

FIG. 2 shows a plan, fragmentary section view of the bowl, blade and screen assembly shown in FIG. 1;

FIG. 3 shows a fragmentary section view taken along lines 3—3 in FIG. 2;

FIG. 4(*a*) and FIG. 4(*b*) show enlarged fragmentary, plan section views of the profile screen utilized in the separator device with FIG. 4(*a*) illustrating screen wear in a plan view of the screen;

FIG. 4(*c*) shows an enlarged, fragmentary, side section view of the profile screen taken along lines 4(*c*) in FIG. 4(*a*) illustrating screen wear along the height of the screen;

FIG. 5(*a*) shows a partial view of the indexable screen and separator bowl releasably fastened together by a clamp assembly;

FIG. 5(*b*) shows a further embodiment of a clamp assembly for releasably fastening the indexable screen to the separator bowl; and, FIG. 6 shows a fragmentary plan view of a slotted screen flange.

DETAILED DESCRIPTION

Figure 1:
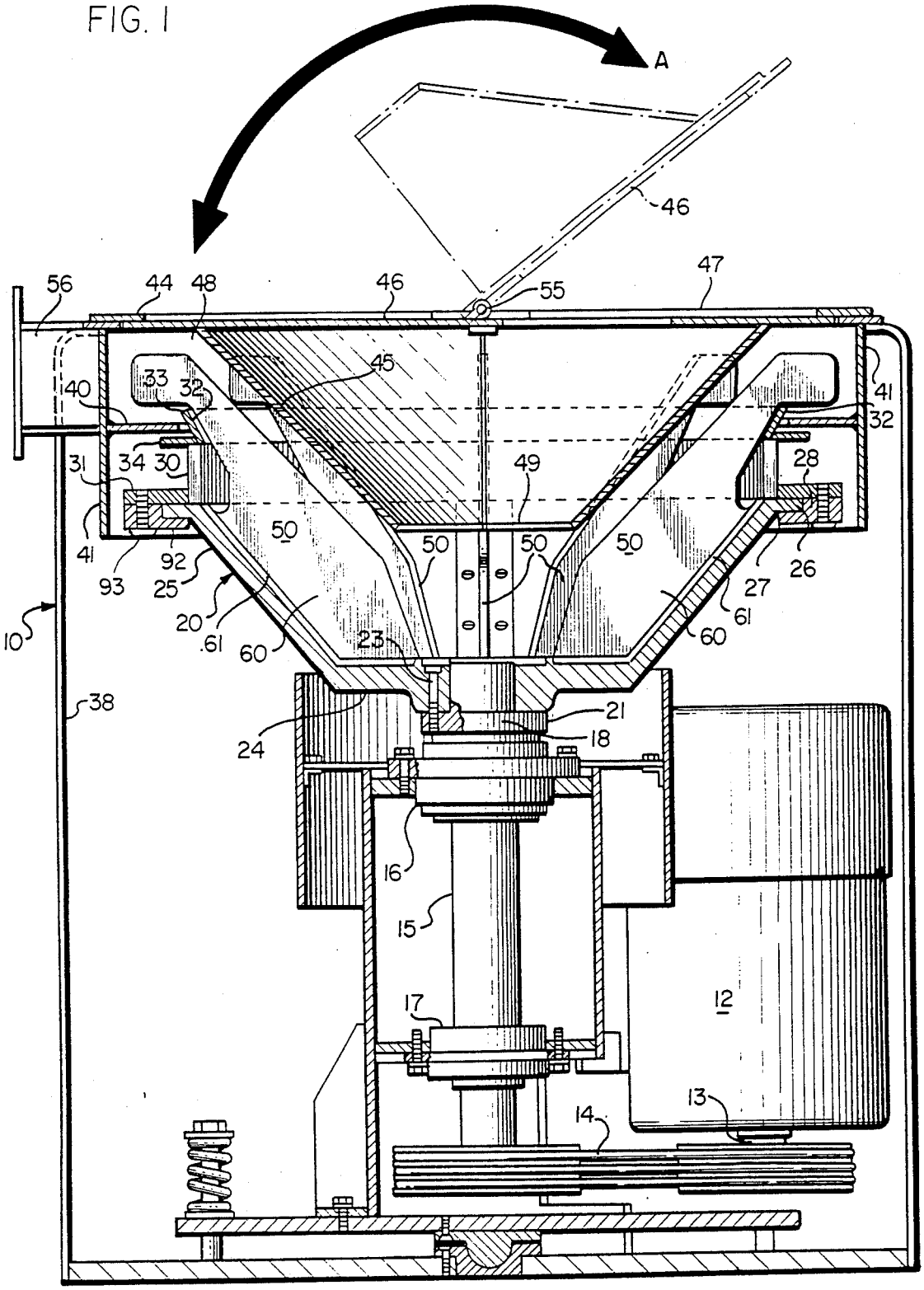
FIG. 1 shows a front, partial section view of the parts separator device of the present invention and shows an indexable screen disposed above and fixed to a rotatable separator bowl having a plurality of blades disposed therein.

Referring to the drawings and particularly FIG. 1, there is shown centrifugal separator device 10 which includes motor 12 which has a drive shaft 13 connected by belt and pulley drive assembly 14 to one end of centrifugal separator drive shaft 15. Shaft 15 is disposed within two bearing assemblies 16, 17.

Hub 18 is fixedly disposed on the remaining end of drive shaft 15 and a substantially bell-shaped separator bowl 20 is seated on flange 21 of hub 18. Separator bowl 20 has an opening 22 (FIG. 2) which, when bowl 20 is seated on hub 18, provides a close fit between the bowl opening and hub 18. A plurality of bolts 23 serve to releasably fasten the bowl to hub 18 whereby, upon actuation of motor 12, bowl 20 connected to shaft 15, rotates.

Bottom wall 24 of separator bowl 20, which has inner and outer wall surfaces, extends outwardly and terminates in bowl wall 25 which extends vertically upwardly and outwardly with a mounting flange 26 located at end 27 of bowl wall 25. Bowl wall 25 also has inner and outer wall surfaces.

A substantially cylindrical separator screen 30 having openings therein to permit passage of lubricant or other fluids therethrough without permitting passage of shavings, chips or other materials, extends upward from bowl flange 26. Screen 30 serves to permit discharge of lubricating liquid which is separated from the metal chips in a separation operation. Screen 30, which has a flange 31 located at the bottom thereof, is secured to bowl flange 26 by means of a plurality of fastener assemblies 28 which connect flanges 26 and 31.

Conical portion 32 is secured to the upper edge of screen 30 and extends radially outward in an upward direction to provide a dispensing edge 33. A radially extending flange 34 is secured to the top of screen 30 of the centrifugal separator bowl 20 intermediate the juncture between the conical portion 32 and screen 30.

Liquid discharged through the openings 80 in screen 30 (FIGS. 4(*a*), (*b*)) will be collected in a suitable collection chamber, not shown, preferably disposed within casing chamber 38 in which the parts separator device is disposed.

A radially, inwardly directed flange 40 is secured to cylindrical wall member 41 which depends from and is attached to the top of chamber 38 as seen in FIG. 1.

Cover 44 is fixed in any desired manner to the upper edge of chamber 38. In this particular embodiment, cover 44 includes an upper conical member 45 which is fixedly attached to and depends from cover 44. Conical member 45 comprises two pivotable cone-shaped portions 46, 47 whereby the outer wall of conical member 45 defines the inner wall of a second annular chip collecting chamber 48 and the cylindrical wall member 41 defines the outer wall thereof.

Cone 45 converges in a downward direction to a location spaced immediately above and within separator bowl 20. Opening 49 at the bowl end of conical member 45 defines an air inlet as well as a material inlet for shavings, chips or the like into centrifuge 10.

Spaced blade assemblies 50, which are shown and disclosed in Nemedi U.S. Pat. No. 4,936,822, the disclosure of which is incorporated herein by reference, are securely and releasably fastened to and rotate with rotatable separator bowl 20.

In the course of a typical operation, metal chips and lubricating fluids are delivered to the centrifuge 10 where they pass through conical member 45 which, as illustrated in FIG. 1, is in an open position with hinged cone portion 46 pivoted at 55, in the position located in the direction of arrow A.

The fluid mixed with the metal chips passes into rotating separator bowl 20 where the materials to be separated are forced outwardly and upwardly along the internal wall of bowl 20 and the leading surface of the blades 60 which is the blade surface which leads in the direction of rotation. For example, blade rotation is shown in the clockwise direction by arrow B in FIG. 2. The leading blade surface when rotation is in the direction of arrow B is 71 and the trailing blade surface is 72.

The materials pass over screen 30 where the lubricating fluid is separated from the chips and passes through tapered openings 80 (FIG. 4(*b*)) in screen 30 to a collection chamber (not shown) where the lubricating fluid is collected and recirculated or otherwise removed from the system. The metal chips separated from the fluid are directed upward over screen 30 past dispensing edge 33 where they are blown or pulled out of discharge chamber 48 and exit chute 56 to a collecting site.

Referring, for example, to FIG. 1 and FIG. 2, separator bowl 20 is shown with a plurality of blade assemblies 50 disposed within and releasably fixed to the bowl. Each blade assembly 50 includes blade 60 and pad 61. Blade 60 extends outward from pad 61 so that when assembly 50 is installed in bowl 20, blade 60 projects upward over screen 30 into chamber 48 as shown in FIG. 1. Blade 60 and pad 61 are fixed relative to bowl 20 and screen 30.

Pad 61 has a plurality of openings, not shown, which are adapted to be aligned with threaded openings in a recess located in bowl 20. Conventional fastening screws are threaded into the openings whereby a blade assembly 50 is securely fastened to the internal wall of separator bowl 20.

If desired, the blade and pad assembly shown in the Nemedi '822 patent need not be utilized. Instead, the blades may be fastened directly to the bowl wall such as shown in U.S. Pat. No. 4,137,176. Further, if desired, a double blade assembly such as shown and disclosed in U.S. Pat. Nos. 4,253,960 and 4,298,476 could be employed. Wear on the screen also will occur with these systems.

It has been found that wear in centrifuge separator systems presently available often occurs at the location of the leading surface of a blade. When such wear occurs, one can replace a particular worn blade assembly 50 such as disclosed in the Nemedi '822 patent.

While the replacement of the blade assembly 50 has served to reduce wear in bowl 20, it has been found that wear also occurs at various locations on screen 30 and particularly at those locations on the screen positioned above and contiguous to blades 60 which extend upward beyond the top of bowl wall 25.

Screen 30 includes a plurality of closely spaced elongated stainless steel fingers 81 having an enlarged head 83 which is tapered inwardly from the screen front surface to screen back surface. A tail 84 extends out from the back surface of finger head 83. Tail 83 is reduced in thickness relative to head 83. Fingers 81 are assembled to form a circular member which is set in circular top ring plate 85 and bottom ring plate 86 (FIG. 3). If desired, an additional circular ring member, not shown, can be positioned intermediate rings 85, 86, the ring being disposed in a recess notched into the back of finger tails 84.

As will be observed from viewing FIG. 4(*a*)–FIG. 4(*c*), finger heads 83 lie in close proximity to one another whereas finger tails 84 are spaced further apart from one another. In one profile screen embodiment, the minimum width of space 80 formed by the front surfaces of adjacent finger heads 83 is 0.02 inch whereas the width X between adjacent finger tails 84 is 0.12 inch. Opening 80 increases in size as the fingers taper inwardly going from the front surface to the back surface of fingers 81. Opening 80 permits fluid separated from the chips or other material during a separation process to pass through the narrow screen openings 80 whereas substantially all the solid materials will travel upward along the front surface 82 of finger heads 83 where they pass out into discharge chamber 48 and then on to a collection container. When wear is experienced with profile screen 30, what has been found is that the front surface of adjacent finger heads 83 located contiguous to a blade 60 will wear, as illustrated at Y in FIG. 4(*a*), such that screen openings 80 increase in size to such an extent that a relatively substantial and undesired amount of chips escape through screen opening 80. Further, the screen will wear along the height of fingers 81 as illustrated by Z in FIG. 4(*c*).

In time, screen 30, which is a relatively expensive component of the separator device, must be removed and replaced due to the wear problem. To obviate this screen wear problem, it has been found that screen 30 can be rotated or indexed relative to separator bowl 20 to present a relatively unworn screen surface particularly at the location of screen 30 and the blades 60 while at the same time moving the worn screen surface to a new location relative to the blades 60. Indexing the screen serves to increase the life of screen 30 while at the same time obviating the problem of having undesired chips or other solids pass through openings 80 in screen 30.

When it is necessary or otherwise desirous to index screen 30 to offset wear areas, fastener assemblies 28 can be disassembled whereby screen flange 31 and bowl flange 26 are disconnected from each other. Screen 30 is rotated on bowl flange 26 to a new desired position, whereupon fastener assembly 28 is reassembled thereby releasably connecting together screen flange 31 and bowl flange 26 such that the screen and bowl rotate together upon actuation of separator 10.

In one embodiment, fastener means or assembly 28 includes a lug 90 having base 91 and arm 92 extending from lug base 91. Base 91 is adapted to seat against the bottom surface of screen flange 31 whereas lug arm 92 seats against the bottom surface of bowl flange 26. Bolt 93 passes through an opening in lug base 90 and either is threaded into a threaded opening in screen flange 30 or threaded into a locking nut thereby drawing and locking together screen flange 31 and bowl flange 26. A plurality of fastener assemblies 28 can be utilized to lock screen 30 to bowl 25 once the desired indexing or rotation has occurred.

As an alternative to the use of bolts 93, fastener assembly 28 can utilize a C clamp 94 (FIG. 5(*a*)) to lock screen flange 31 to bowl flange 26. It is appreciated that one must be careful not to have the clamp become loose but rather the C clamp must clamp lug 90 tightly to screen flange 31.

A further embodiment contemplates extending bowl flange 26 and screen flange 31 outwardly as seen in FIG. 5(*b*). A C clamp 95 having bolt 96 is threaded through clamp 95 to draw flanges 26 and 31 tightly together.

FIG. 6 shows a further embodiment of screen 30 in which screen flange 31 includes a plurality of arcuate slots 98. Upon loosening of bolts 93, FIG. 3, screen 30 can be rotated or indexed relative to bowl flange 26 for the distance of the arcuate length of slots 98. Bolts 93 then can be retightened to releasably lock screen 30 to separator bowl 20. With this indexing procedure, screen 30 can be repositioned relative to the leading surfaces of the blades 60 and bowl wall 20.

While one or more embodiments of the invention have been herein illustrated and described in detail, it will be understood that modifications and variations thereof may be effected without departing from the spirit of the invention and the scope of the appended claims.

What is claimed is:

1. The method of reducing wear on the surface of a screen used in a centrifugal separator device which device comprises a rotatable bowl having one or more blade assemblies fixed in an rotatable with said bowl said blade assemblies having a blade having a leading surface and a screen releasably attached to the top of said bowl, according to the steps of:

(a) assessing said screen for wear on the surface of said screen;

(b) disconnecting said screen from said separator bowl;

(c) moving said screen relative to said bowl so as to move a wear area on said screen surface from at least a first position to a second position relative to said bowl where the wear area of said screen is spaced away from said blade; and, (d) releasably connecting said screen to said bowl whereby said screen is fixed to and rotatable with said bowl at said second position.

2. The method of claim 1 and further repeating the steps of (a)-(d) inclusive.

3. The method of claim 1 and further including the step of moving said screen whereby a screen wear area is positioned away from a leading blade surface.

4. The method of increasing the wear life of a screen used in a centrifugal parts separator wherein said separator comprises;

a rotatable separator bowl disposed within said separator, the bowl including a bottom wall and an inclined vertical wall;

means for rotating said bowl;

at least one blade assembly disposed within said bowl, said blade assembly including a blade positioned along at least said inclined bowl wall;

a separator screen releasably joined to said rotatable bowl and adapted to rotate with said bowl;

said method comprising the steps of:

(a) assessing said screen for a worn area in the region of the screen located contiguous to said blade;

(b) releasing the screen from said bowl whereby said screen is adapted to be moved from a first position where said worn area of the screen is contiguous with said blade;

(c) moving said screen to a second position where the worn area of the screen is spaced away from said blade and, (d) releasably fastening said screen to said bowl when said screen is in said second position.

5. The method of claim 4 wherein said screen is assessed for worn area after said screen is in said second position and said screen is moved to a third position in which said worn area on said screen is spaced from said blade.

6. The method of claim 4 wherein said bowl includes a plurality of spaced blade assemblies including a plurality of blades spaced from each other; and, assessing the screen for wear at the area of the screen contiguous to each blade; and, positioning said worn screen area relative to said bowl so that said worn areas of said screen are spaced from said blades.

7. A method in accordance with claim 4 wherein said rotatable bowl has a flange and said screen has a flange and said bowl and screen flanges contact one another at the location of said flanges, said method including the steps of:

unfastening said bowl and screen at the location of said flanges;

moving said screen and bowl flanges relative to one another from a first position where the screen has a worn area at the location of said blade to a second position where the worn screen area is spaced from said blade;

and fastening said screen to said bowl whereby said screen is in said second position relative to said bowl.

8. A method in accordance with claim 7 wherein said one of said flanges includes a plurality of slots and said fastening means are disposed, in part, within said slots, said method further including:

releasing said fastening means;

moving said screen flange and bowl flange relative to each other whereby said fastening means moves from a first position to a second position in said slots; and, refastening said bowl and screen together in said second position.

* * * * *

UNITED STATES PATENT AND TRADEMARK OFFICE

CERTIFICATE OF CORRECTION

PATENT NO. : 5,330,637

DATED : July 19, 1994

INVENTOR(S) : ROBERT J. NEMEDI

It is certified that error appears in the above-identified patent and that said Letters Patent is hereby corrected as shown below:

Col. 6, line 27, following "C" insert --type--;

Col. 6, line 30, following "C" insert --type--;

Col. 6, line 34, following "C" insert --type--; and

Signed and Sealed this

Sixth Day of December, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,330,637

DATED : July 19, 1994

INVENTOR(S) : ROBERT J. NEMEDI

It is certified that error appears in the above-identified patent and that said Letters Patent is hereby corrected as shown below:

Col. 6, line 56, delete "an" and insert --and--.

Signed and Sealed this

Thirteenth Day of June, 1995

*Attest:*

*Attesting Officer*

BRUCE LEHMAN

*Commissioner of Patents and Trademarks*